US007819047B1

(12) United States Patent
Mitchell

(10) Patent No.: US 7,819,047 B1
(45) Date of Patent: Oct. 26, 2010

(54) SYSTEM AND METHOD TO CENTRIFUGALLY CAST MUNITIONS

(75) Inventor: Steven W. Mitchell, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 327 days.

(21) Appl. No.: 11/961,946

(22) Filed: Dec. 20, 2007

(51) Int. Cl.
*B21D 22/14* (2006.01)

(52) U.S. Cl. ..... 86/56

(58) Field of Classification Search ..... 86/54, 86/56

See application file for complete search history.

(56) References Cited

U.S. PATENT DOCUMENTS

| | | | | |
|---|---|---|---|---|
| 2,212,383 | A * | 8/1940 | Yeomans | 102/473 |
| 5,305,505 | A * | 4/1994 | Ruhlman | 86/56 |
| 5,634,189 | A * | 5/1997 | Rossmann et al. | 428/547 |
| 5,980,792 | A * | 11/1999 | Chamlee | 264/40.1 |
| 6,935,406 | B2 * | 8/2005 | Flemings et al. | 164/114 |

* cited by examiner

*Primary Examiner*—Stephen M Johnson
(74) *Attorney, Agent, or Firm*—Schwegman, Lundberg & Woessner, P.A.

(57) ABSTRACT

An apparatus for manufacturing munitions includes a housing and a munition mold within the housing. The housing has an axis of rotation. The munition mold is filled with a molten metal, and the mold is rotated to form a munition.

7 Claims, 3 Drawing Sheets

SYSTEM AND METHOD TO CENTRIFUGALLY CAST MUNITIONS

TECHNICAL FIELD

Various embodiments relate to the manufacture of munitions, and in an embodiment, but not by way of limitation, to centrifugally cast munitions.

BACKGROUND

Current anti-submarine warfare and anti-mine munitions (e.g., darts, projectiles, torpedoes, and other high performance penetrating projectiles) are manufactured by machining multiple pieces of various materials (such as tungsten, aluminum, and steel), and then assembling those pieces to obtain the requisite material properties such as center of mass, hardness, and shape. This requires multiple machining and assembly steps, all of which require skilled labor resulting in increased unit costs. Moreover, joints between the component parts are potential points of weakness, and darts constructed in this way have been observed during testing to break apart while penetrating the water-air or the air-ground interfaces due to unsustainable torque across a joint.

DETAILED DESCRIPTION

Figure 1:
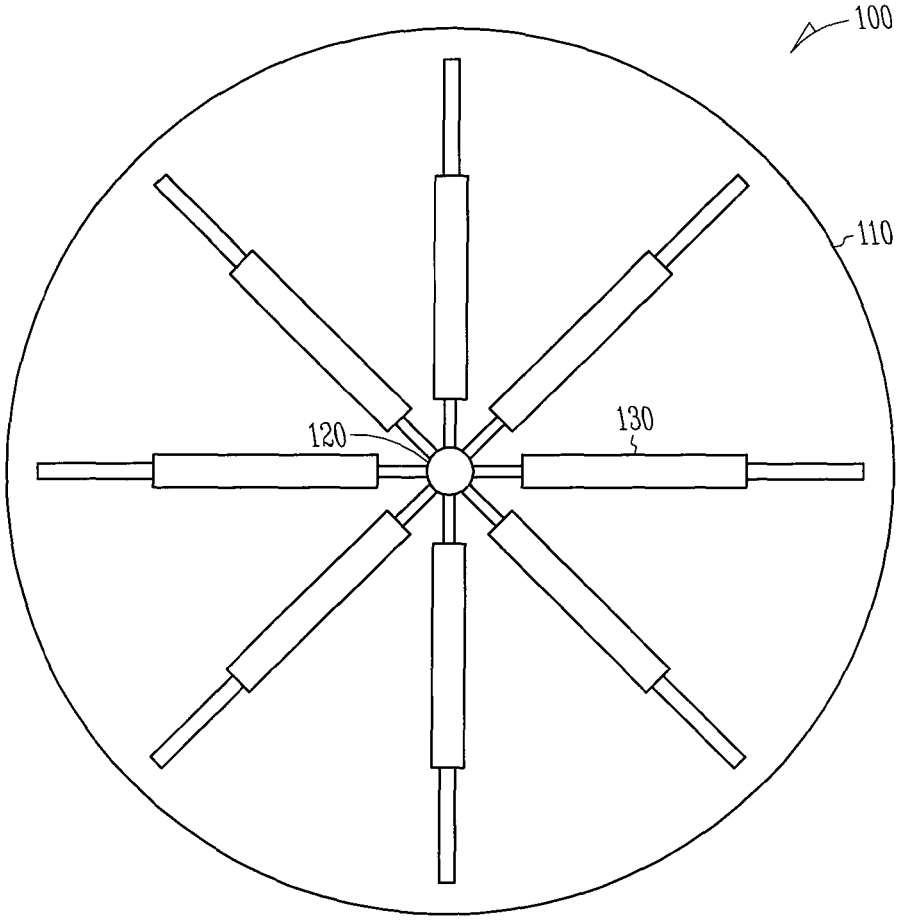
FIG. 1 is a top view of an example embodiment of an apparatus to centrifugally cast munitions.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

One or more figures show block diagrams of systems and apparatus of embodiments of the invention. One or more figures show flow diagrams illustrating systems and apparatus for such embodiments. The operations of the flow diagrams will be described with references to the systems/apparatuses shown in the block diagrams. However, it should be understood that the operations of the flow diagrams could be performed by embodiments of systems and apparatus other than those discussed with reference to the block diagrams, and embodiments discussed with reference to the systems/apparatus could perform operations different than those discussed with reference to the flow diagrams.

In the art of munitions, proper performance requires tight control of external shape, mechanical properties, and mass properties. Careful engineering with thorough modeling, analysis, and testing can produce darts made of multiple pieces that do not break apart in flight. However, the current manufacturing approach is inherently costly. The combined requirements of tight control of mass properties, physical properties (including shape and strength), and low production costs in the past have been addressed only by outsourcing production to low labor cost areas. However, even if labor costs can be virtually eliminated, darts made of multiple components are likely to be significantly more expensive than cast darts.

In an embodiment, near-net-shaped darts are cast in a centrifugal casting machine from a metal matrix composite such as tungsten fibers in an aluminium alloy matrix. The long axis of the mold for the dart is normal to the axis of rotation, with the point of the dart farthest away from the axis. Multiple darts may be cast at once, with the individual dart molds arranged like spokes radiating from the axis of rotation. This arrangement can be referred to as a "wagon wheel." The metal matrix composite can be poured through a tundish that is coupled to the axis of rotation. The casting machine is spun at an appropriate speed to get the desired segregation of heavy components away from the axis of rotation. As the metal matrix composite cools in the dart molds, the heavy composite fibers (e.g., tungsten) concentrate in the nose of the dart, thereby providing the required mass distribution. The cooling rate is controlled to produce the required continuous distribution of heavy composite fibers down the length of the dart, thereby providing the desired mechanical properties such as strength. Metal or shell molds can be used in this process, producing castings which require little or no machining to meet the dimensional requirements.

Figure 2:
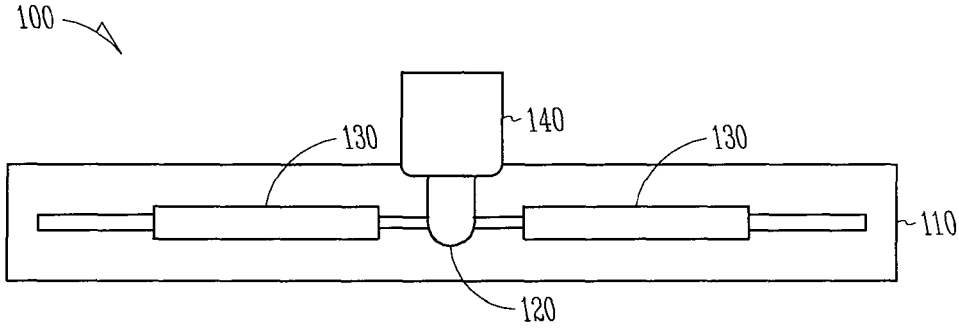
FIG. 2 is a side view of an example embodiment of an apparatus to centrifugally cast munitions.

FIGS. 1 and 2 illustrate an example embodiment of an apparatus 100 for centrifugally casting munitions. The apparatus 100 includes a housing 110, a munition mold 130 within the housing 110, and an axis of rotation 120. In the embodiment of FIG. 1, the housing 110 is circular, thereby forming a radius and a circumference. As illustrated in FIG. 1, the housing 110 can include a plurality of munition molds 130 that are substantially aligned along the radius of the housing 110, thereby forming a "wagon wheel" of molds 130. The munition molds 130 can include an anti-submarine munition mold, an anti-mine munition mold, and/or molds for other munitions now known in the art or later developed. The apparatus 100 can further include a means to rotate the housing and mold about the axis of rotation. An example of such a means is an electric motor or combustion engine, coupled to some sort of drive train and/or gear system to create the rotation. The apparatus can further include a means to alter the rotation speed of the housing, such as a variable speed motor. The apparatus 100 can further include a tundish 140. The tundish 140 is for receiving a molten metal that is used to form the munitions in the mold 130. In another example embodiment, the molds 130 can be stacked upon one another (that is, two or more wagon wheels are stacked upon each other). In such a stacked embodiment, the tundish 140 is coupled to each stack level.

Figure 3:
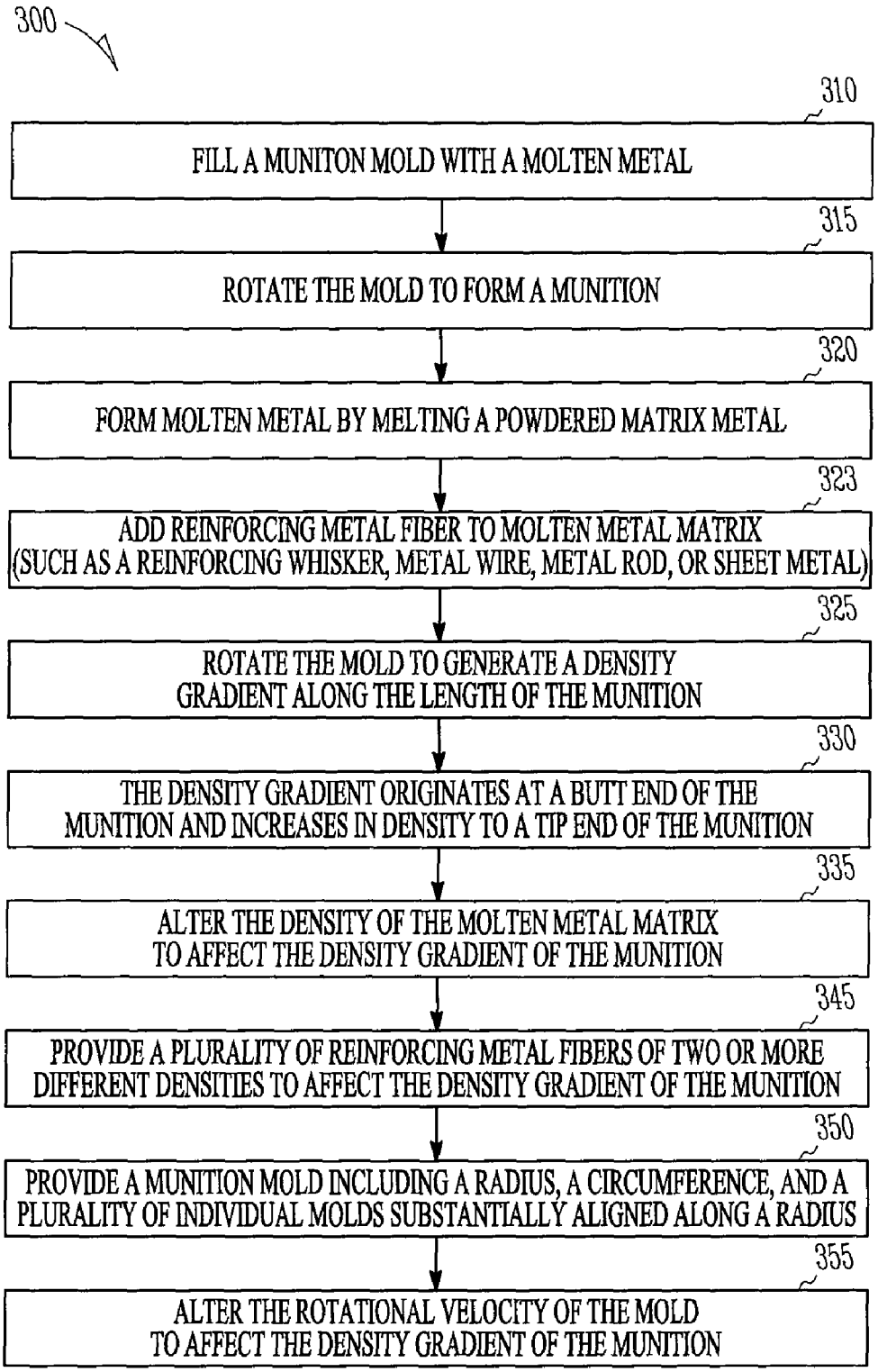
FIG. 3 illustrates an example embodiment of a process to centrifugally cast munitions.

FIG. 3 is a flowchart of an example process 300 for centrifugally casting munitions. FIG. 3 includes a number of process blocks 310-355. Though arranged serially in the example of FIG. 3, other examples may reorder the blocks, omit one or more blocks, and/or execute two or more blocks in parallel.

In the process 300, starting at 310, a munition mold is filled with a molten metal. As noted above, the munition can be an anti-submarine munition, an anti-mine munition, and/or some other type of munition now known or later developed. At 315, the mold is rotated to form a munition. At 320, the molten metal is formed by melting a powdered matrix metal. At 323, reinforcing metal fibers are added to the molten metal matrix. Examples of reinforcing metal fiber includes reinforcing whiskers (typically single crystals of metal), metal rods, metal wires, and sheet metal strips. At 325, the rotation of the mold generates a density gradient along the length of the munition. At 330, the density gradient originates at the butt end of the munition and increases in density along the munition to the tip end of the munition. At 335, the density of the molten metal matrix is altered to affect the density gradient of the munition. This density can be affected with a mix of high melting point metals and low melting point metals. At 345, a plurality of reinforcing metal fibers of two or more different densities are provided so as to affect the density gradient of the munition. At 350, the munition mold includes a radius, a circumference, and a plurality of individual molds that are substantially aligned along the radius of the mold. At 355, the rotational speed of the mold is altered to affect the density gradient of the munition.

Figure 4:
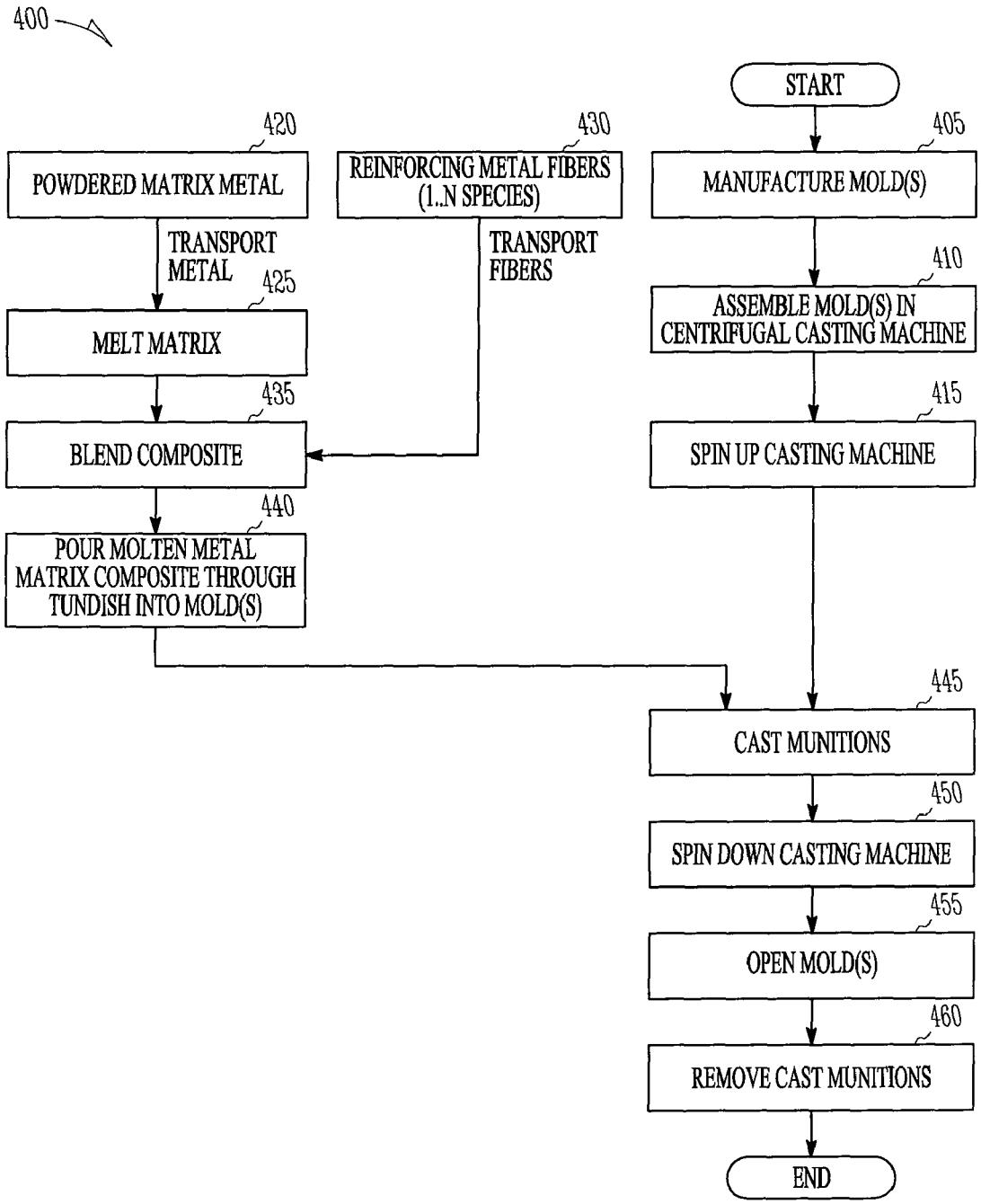
FIG. 4 illustrates another example embodiment of a process to centrifugally cast munitions.

FIG. 4 is a flowchart of another example embodiment of a process 400 for centrifugally casting munitions. At 405, the munition molds are manufactured. At 410, the molds are assembled into a centrifugal casting machine. At 415, the casting machine is spin up. The mold may be pre-heated, and if pre-heated, it may be done either before spinning up or while spinning up. Pre-heating a mold helps avoid thermal stress shattering which could result from pouring the molten metal matrix into a cold mold. Pre-heating a mold also aids in uniform filling of the mold. At 420, a powdered metal matrix is provided, and at 425, that metal matrix is melted. At 430, one or more reinforcing metal fibers are provided, and at 435, the melted metal matrix and the reinforcing metal fibers are blended into a composite. If there are multiple species of reinforcing metal fibers, they may be added all at once or sequentially. At 440, the molten metal matrix is poured into the molds via a tundish, and at 445, the munitions are cast. If the molds are in a multi-level stack, the amount of molten metal matrix can be varied to fill the desired number of molds. After spinning for the desired period of time, the casting machine is spun down at 450. The molds are then opened at 455, and the munitions removed at 460.

Thus, an example system and method for centrifugally casting munitions has been described. Although specific example embodiments have been described, it will be evident that various modifications and changes may be made to these embodiments without departing from the broader scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract is provided to comply with 37 C.F.R. §1.72(b) and will allow the reader to quickly ascertain the nature and gist of the technical disclosure. It is submitted with the understanding that it will not be used to interpret or limit the scope or meaning of the claims.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate example embodiment.

The invention claimed is:

1. A process comprising:

forming a molten metal by melting a matrix metal;

adding a reinforcing metal fiber to the molten metal;

filling a munition mold with the molten metal; and rotating the mold to form a single-piece munition;

wherein the reinforcing metal fiber comprises materials of two or more different densities such that the rotating forms a density gradient along the length of the munition.

2. The process of claim 1, wherein the reinforcing metal fiber comprises one or more of a reinforcing whisker, a metal wire, a metal rod, and a sheet metal.

3. The process of claim 2, wherein the density gradient originates at a butt end of the munition and increases in density to a tip end of the munition.

4. The process of claim 1, comprising altering the density of the molten metal matrix to affect the density gradient of the munition.

5. The process of claim 1, wherein the munition mold comprises a radius, a circumference, and a plurality of individual molds substantially aligned along radii.

6. The process of claim 1, comprising altering the rotational velocity of the mold to affect the density gradient of the munition.

7. The process of claim 1, further comprising the munition.

* * * * *